United States Patent [19]

Honigman

[11] Patent Number: 4,910,932

[45] Date of Patent: Mar. 27, 1990

[54] MODULAR BUILDING SYSTEM

[76] Inventor: Michael L. Honigman, 12332 Chapman St., Garden Grove, Calif. 92640

[21] Appl. No.: 642

[22] Filed: Jan. 5, 1987

[51] Int. Cl.[4] ..... E04H 12/00

[52] U.S. Cl. ..... 52/280; 52/282; 52/648

[58] Field of Search ..... 52/79.1, 79.2, 79.9, 52/79.12, 79.13, 234, 235.1, 239-243, 243.1, 278, 281, 285, 204, 648, 280

[56] References Cited

U.S. PATENT DOCUMENTS

| | | | |
|---|---|---|---|
| 2,255,194 | 9/1941 | Stout et al. | 52/280 |
| 3,256,652 | 6/1966 | Van Der Lely | 52/79.9 |
| 3,307,894 | 3/1967 | Collier | 312/257 R |
| 3,626,649 | 12/1971 | Ohkawa | 52/234 |
| 3,642,310 | 2/1972 | Hudson | 52/648 X |
| 3,831,336 | 8/1974 | Diemer | 52/648 |
| 3,885,367 | 5/1975 | Thunberg | 52/204 |
| 3,971,172 | 7/1976 | Gentil | 52/28 |
| 4,205,497 | 6/1980 | Schirm | 52/90 |
| 4,258,511 | 3/1981 | Strain | 52/79.1 |
| 4,275,534 | 6/1981 | Porter | 52/648 X |
| 4,782,637 | 11/1988 | Eriksson et al. | 52/648 X |

FOREIGN PATENT DOCUMENTS

| | | | |
|---|---|---|---|
| 0112300 | 6/1984 | European Pat. Off. | 52/280 |
| 2902322 | 7/1980 | Fed. Rep. of Germany | 52/79.9 |

*Primary Examiner*—Carl D. Friedman
*Attorney, Agent, or Firm*—Henry M. Bissell

[57] ABSTRACT

A modular building design includes a building frame construction of superior strength and rigidity with roof, floor and wall panels designed for insertion in modular frame openings. The design permits complete fabrication of all shell components in a central manufacturing facility and is such that the various elements may be shipped or stored in an essentially flat package configuration. The only tools required for erection on the building site are conventional wrenches and nut drivers. The need for skilled workmen at the site is virtually eliminated.

10 Claims, 13 Drawing Sheets

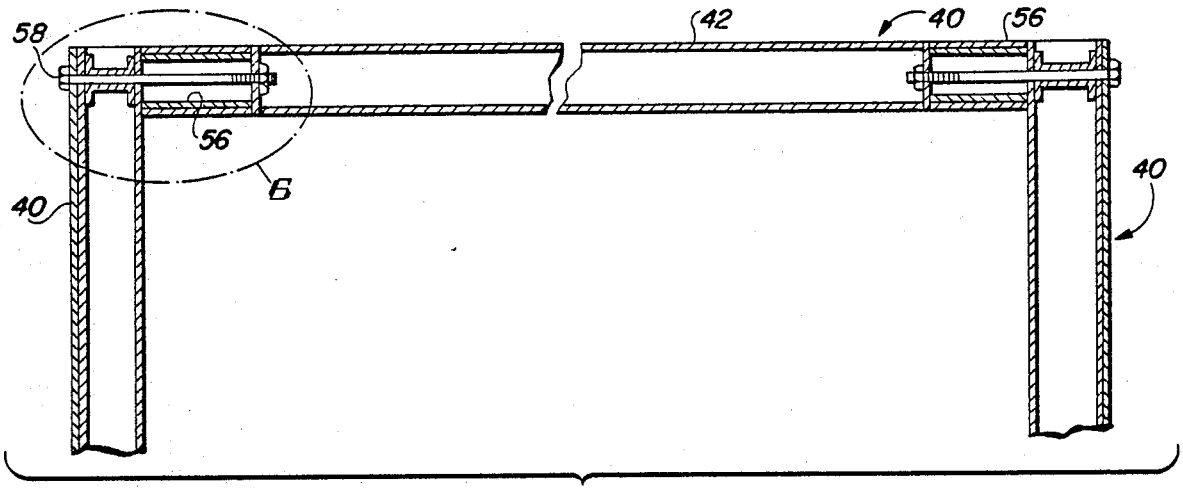
FIG. 5
FIG. 8
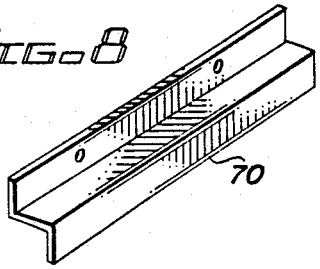
FIG. 9
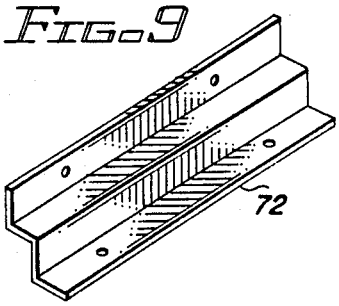
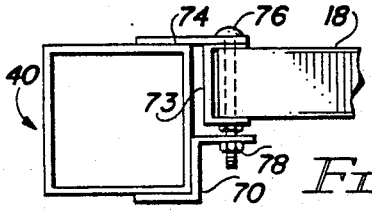
FIG. 10A
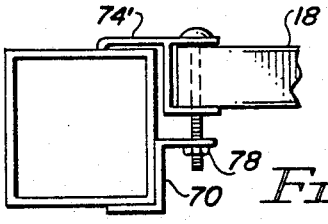
FIG. 10B
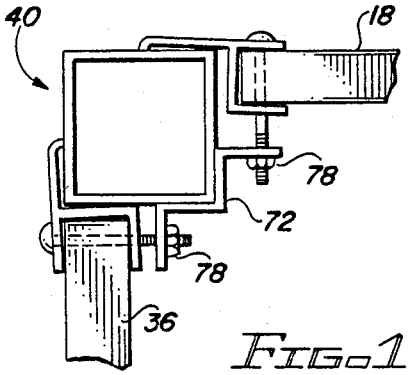
FIG. 11
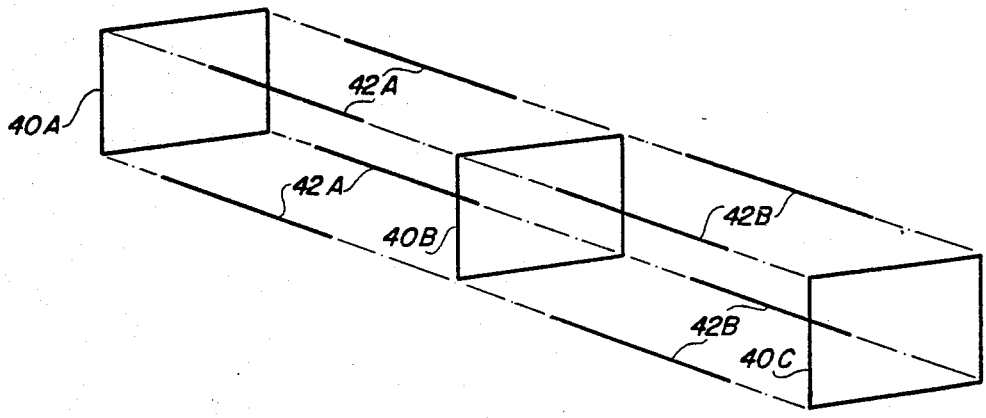
FIG. 12

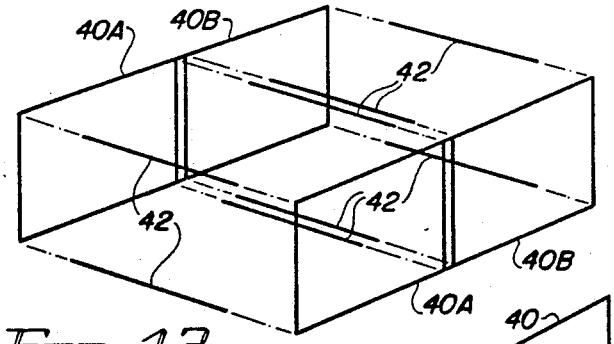
FIG. 13
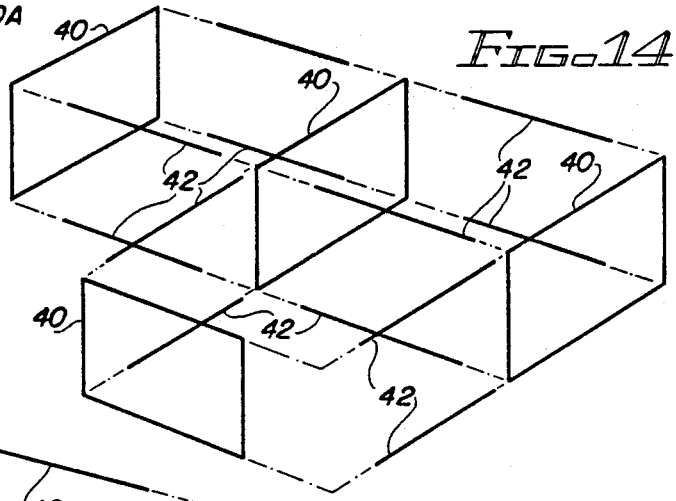
FIG. 14
FIG. 15
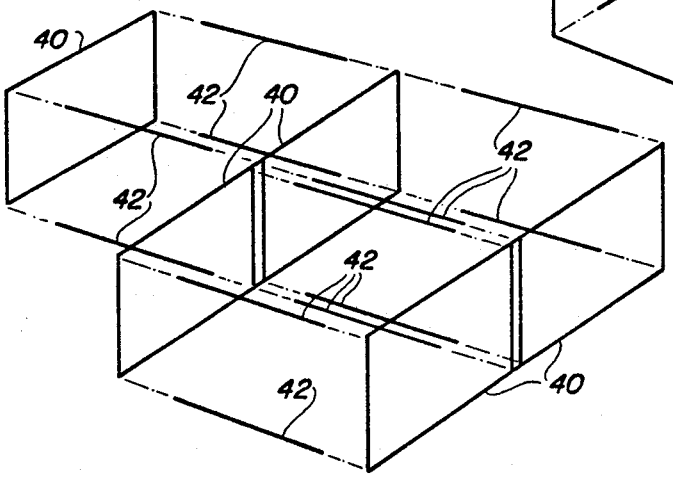
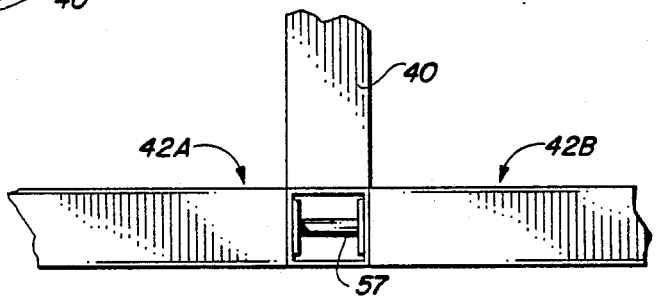
FIG. 16B
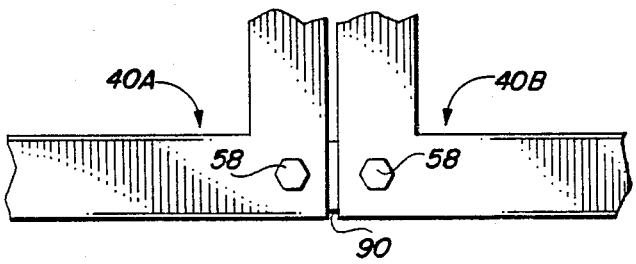
FIG. 17B

MODULAR BUILDING SYSTEM

BACKGROUND OF THE INVENTION

The present invention relates to modular building systems and, more particularly, to such systems which comprise modular frames and panels of a configuration such that all components on the building module can be fabricated in a factory, transported in a kit and erected in the field with minimal requirement of skilled labor and specialized tools.

There has long been a need for so-called modular housing. The need for such housing is present from time to time in a variety of use applications. Examples of such are disaster housing, hospitals, school classrooms, storage warehouses, field offices military uses, room additions, shipping containers, and auxiliary structures to almost any kind of building. Numerous approaches to providing various types of modular housing have been proposed. These include Quonset huts, Dallas huts, inflatable structures, trailers, mobile homes, and various types of prefabricated structures. While these may have the capability of providing the desired enclosures in certain applications, all of these types of temporary enclosures, so far as is known, present drawbacks of two major types: either they are substantially constructed in a factory, in which case transportation to the site is a problem, or too much is left to construction on the site, in which case the erection costs are high because of the need for skilled workmen and specialized tools at the site, or both. Indeed, structures of the latter type may be precluded from consideration for use in some areas of the world where the population does not have the equipment or skilled personnel to finish construction of the buildings from the prefabricated units that are shipped from a factory.

Arrangements in accordance with the present invention satisfy the need for modular building construction and obviate the drawbacks in presently known temporary housing by providing prefabricated elements in a flat, essentially two-dimensional configuration which permits all of the elements for a given structure to be shipped in a very compact package to the site where erection can be accomplished by the simplest of procedures.

SUMMARY OF THE INVENTION

In brief, arrangements in accordance with the present invention comprise a building frame having main frames and connecting beams which is in part prefabricated in two-dimensional form and in part assembled at the site to develop a three-dimensional box form. The frame in three-dimensional form defines a plurality of openings in the six faces of the rectangular parallelepiped defined by the frame.

Panels to fill these openings are also prefabricated and the combination of prefabricated panels and prefabricated frame elements is configured and assembled for shipment in a very compact, rugged, self protecting package. In this package, the prefabricated main frames when stacked together define spaces for containing the additional beams and other connecting elements for completing the building frame. The wall, floor and roof panels are of comparable extent to the prefabricated main frames and can thus be stacked side by side in the shipping package with protection being provided by the very strong, rigid, prefabricated main frames.

A basic or minimal module, in the preferred embodiment of the present invention, comprises two main frames for the two opposite side walls of the structure. The modular frame is completed by assembly of four connecting beams joining corresponding pairs of corners of the two opposed main frames. As prefabricated, the main frames include a plurality of stub carriers or connectors for easily interconnecting with the cross beams.

The main frames and the connecting beams preferably comprise 4"×4"×⅛" steel box beams. These can be prefabricated in varying lengths according to the dimensions desired for the building to be erected, but the preferred embodiment disclosed herein involves a basic module of nominally 10'×10'×8' or a double module of nominally 10'×20'×8'.

A single welded main frame is 10'8"×8'8"and consists of four sections of the 4"×4"continuous weld box tubing welded together. Also welded in place at each corner of the welded main frame is a transversely directed stub carrier, 4" long. These are provided for the connecting beams to slide over when the building frame is being erected, and the 4" stub carrier matches the internal dimensions of the 4"×4" beam. Each of the connecting beams is constructed with an approximately 4" cutout on one side at each end. This is so that the beam can be readily dropped over the two stub carriers of the corners of the opposed main frames which are to be connected by a given beam.

At each end of the beam, recessed from the end of the beam by the 4" extent of the cutout, is a cross plate which is welded in place transversely of the beam. On the back side of this plate is a nut which is welded in place or otherwise affixed in alignment with a central hole in this transverse plate. The main frame is provided with corresponding holes at each corner which are in alignment with the hole in the transverse plate of the beam when the beam is in position for assembly. During erection of the module, after the main frames are erected and the beams are installed, bolts are inserted through the holes at each main frame corner and threaded into the corresponding nuts. Tightening of these bolts locks the main frames and connecting beams together in a very rigid structure. Thereafter the prefabricated panels for the wall, floor and roof openings are positioned in place and secured by bolted fastenings. The result is a very rugged housing module which is durable, attractive and strong, capable of lasting for many years on the site of construction, if desired. However, since all of the assembling is accomplished with bolts and nuts, it is a simple matter to disassemble the unit and transport it to another site for erection there or to storage, if desired.

A variety of options is available in the fabrication of the panels which are attached to the assembled modular frame to fill the wall, floor and roof openings. In one embodiment, the wall panels may be fabricated from corrugated sheet steel or aluminum of different selected gauges. In another one of these arrangements, the wall panels may be fabricated of foam core sandwich panels with a variety of textured skins. A 4" thick foam core panel can provide insulating properties comparable to those of refrigerators and freezers, depending on the combination of skins and foam which is used. Alternatively, the wall panels may be fabricated of 2" thick foam core panels with textured Masonite skins. The roof may be made of textured 24 gauge galvanized and painted steel and may also be provided with a selection of polystyrene or polyurethane foam cores. The floor panels are typically of plywood sheets set on corrugated sheet steel panels.

The basic module may be extended by repeating the modular construction. A third main frame can be assembled to the basic module with the addition of four connecting beams. Special connectors are provided to attach the additional beams to what now becomes the intermediate main frame. The result is what may be considered a double module having nominal dimensions of 10'×20'×8'. Alternatively, the same double modular dimensions of 10'×20'×8' can be achieved through the use of in-line pairs of main frames for the front and back of the structure, being nominally 8' high by 20' in length, with the front and rear main frames being joined by eight connector beams assembled in the same manner as previously described. As will be shown and described hereinafter, through the use of special connectors for attaching the beams to the main frames the modular construction may be extended in orthogonal directions by attaching the connector beams to existing main frames and adding a main frame to complete each extra basic module.

Because of the extreme strength and rigidity afforded by the modular construction of this system, wherein all individual frame members comprise 4"×4" tubular beams, it is possible to construct multi-story structures, simply by adding modular units on top of the ground floor modules.

BRIEF DESCRIPTION OF THE DRAWING

A better understanding of the present invention may be realized from a consideration of the following detailed description, taken in conjunction with the accompanying drawing in which:

FIG. 5 is a view, partially broken away, showing the interconnection of connector beams and main frames in accordance with the present invention;

FIG. 8 is a view of a first type of connector element provided for assembling wall panels to a building frame in accordance with the invention;

FIG. 9 is a view of a second type of connector element for assembling panels to a building frame in accordance with the present invention;

FIGS. 10A and 10B are sectional views showing how the member of FIG. 8 is installed;

FIG. 11 is a sectional view showing how the member of FIG. 9 is installed;

FIGS. 12–15 are "stick" drawings representing various frame assemblies of main frames and connector beams to develop different arrangements of modular buildings in accordance with the present invention;

FIGS. 16A and 16B are schematic views showing the connection of a pair of beams on opposite sides of a common main frame through the use of a particular extender member in accordance with the present invention;

FIGS. 17A and 17B are schematic views illustrating the connection of a pair of main frames in line through the use of an in-line coupler element in accordance with the present invention;

DESCRIPTION OF THE PREFERRED EMBODIMENTS

Figure 1:
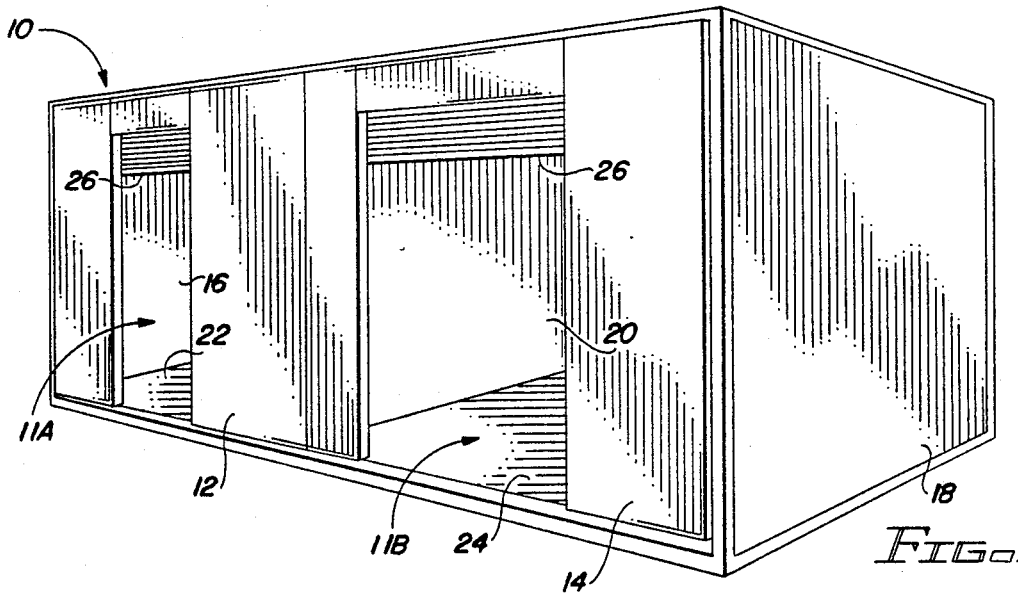
FIG. 1 is a sketch showing a modular building constructed in accordance with the present invention.

FIG. 1 is a perspective view of a modular building 10 constituting a dual module embodiment of the present invention. Building 10 is shown comprising front wall panels 12 and 14, a pair of end wall panels 16, 18, a partition panel 20 and floor panels 22, 24. Each of the front wall panels 12, 14, has an opening in which is mounted a roll-up door 26. The roll-up door 26 is a commercially available item which may be obtained from Roll A Flex Doors Corporation of Anaheim, California. Other types of doors, as well as windows, screens, etc. may be utilized as portions of the wall panels in the modular building system of this invention. The building 10 comprises two bays 11A and 11B each of which corresponds to a basic module of the invention.

Figure 2:
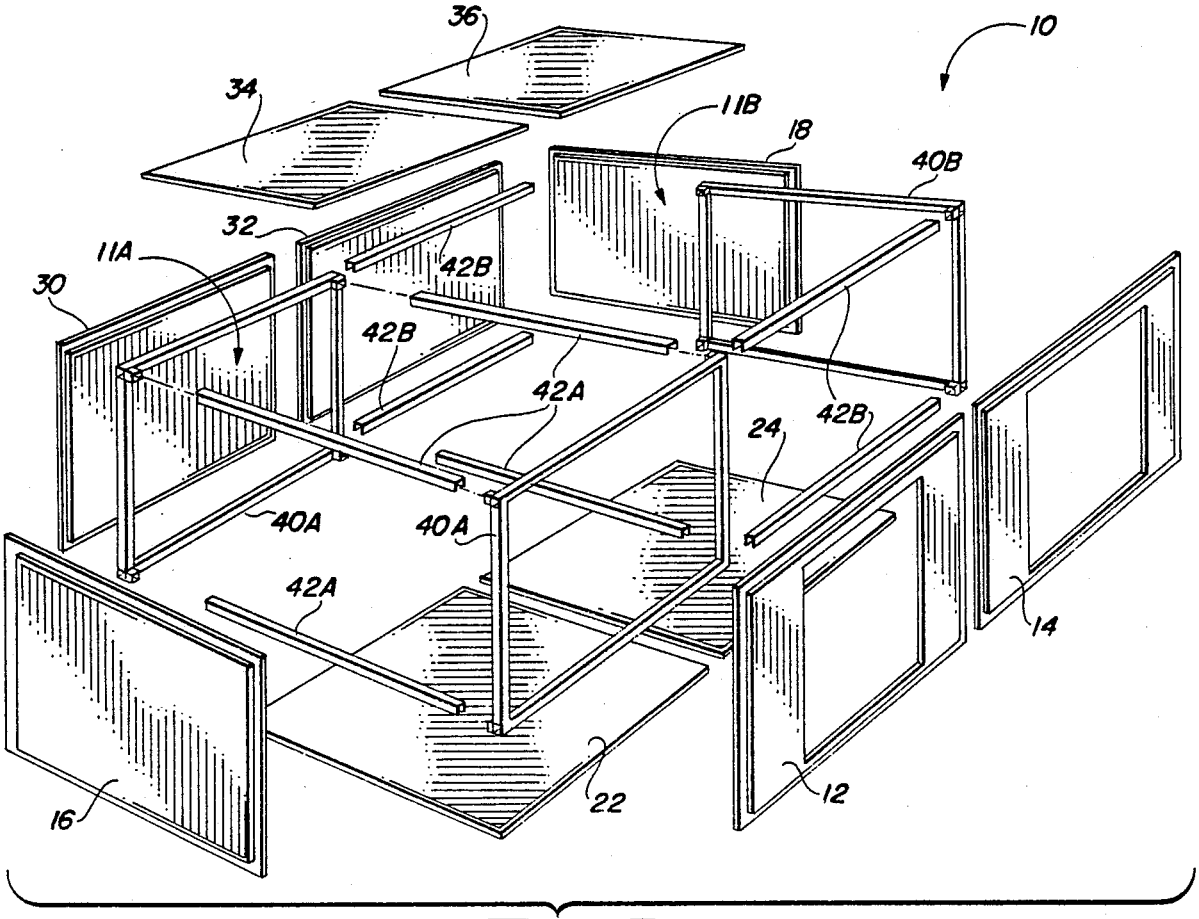
FIG. 2 is a schematic exploded view showing the principal elements used in the construction of the building of FIG. 1, according to one embodiment of the invention.

FIG. 2 is an exploded view showing the various elements utilized in the modular building system of the present invention and may be taken as corresponding to building 10 of FIG. 1 with the omission of the intermediate partition 20 for ease of illustration. Rear wall panels 30, 32 and roof panels 34, 36, not visible in FIG. 1, are also shown in FIG. 2 as are the various elements making up the frame of the building to which the respective panels are mounted. The building frame of the dual module version represented in FIG. 2 comprises three main frames 40—one each, designated 40A, for the front and back walls of the basic module 11A and a third, designated 40B being mounted at the end of the basic module 11B aligned with the end wall panel 18. The main frames 40 are interconnected by connector beams 42, of which there are eight. The four connector beams which are designated 42A extend between respective pairs of corners of the main frames of the basic module 11A these main frames having been designated by the numeral 40A. The remaining four connector beams, which have been designated 42B, are aligned as extensions of the main frames 40A and in the same planes therewith and connect orthogonally to the end wall main frame 40B.

Figure 3:
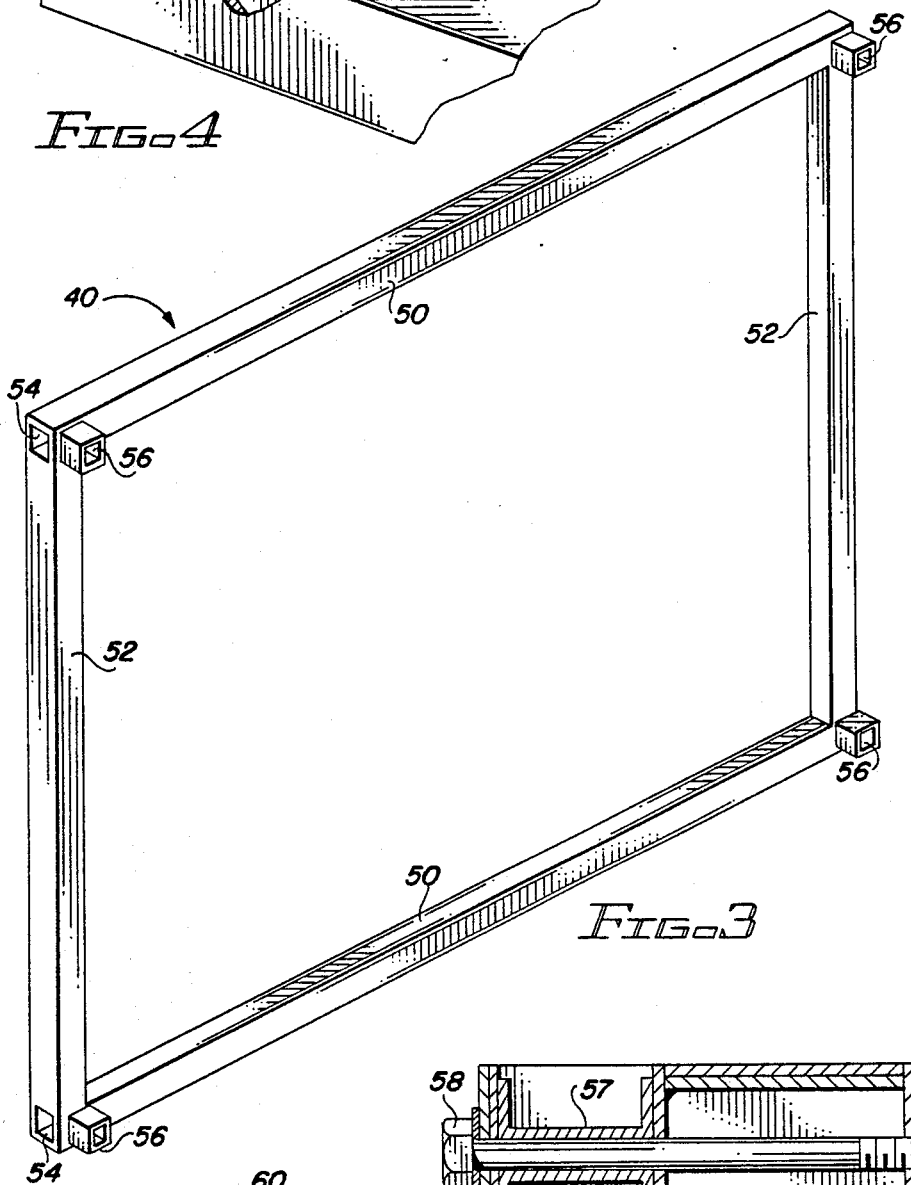
FIG. 3 is a view of a main frame element shown as one of the components in FIG. 2.

FIG. 3 shows a main frame 40 which is constructed by welding together sections of 4"×4" continuous welded box tubing having a wall thickness of ⅛'. The main frame 40 comprises two horizontal sections 50, each 10'8" long, which are welded to two vertical sections 52 which are 8' in length. This establishes an opening which is exactly 8'×10'. The overall dimensions are 8'8"×10'8". Fabrication in this manner leaves the ends 54 of the horizontal box tube sections accessible. A stub carrier 56 is welded at each corner of the main frame 40 to extend approximately 4" in a direction orthogonal to the plane of the main frame 40. The stub carriers 56 are dimensioned to fit the interior opening of the 4"×4" box tubing and are provided to engage the connector beams which attach to the main frame 40.

Figure 4:
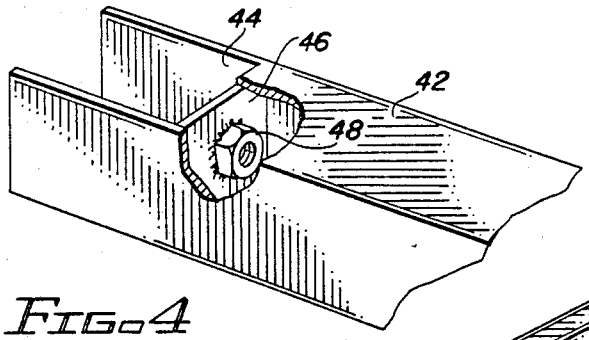
FIG. 4 is a view, partially broken away, showing details of a connector beam element, also shown in FIG. 2.

FIG. 4 shows details of the fabrication of the ends of a connector beam 42, also cut from 4"×4" box tubing. Each beam end is provided with a cutout 44 whereby one wall of the box tubing is removed for an extent of about four inches. This permits the end of the beam 42 to be readily slipped over one of the stub carriers 56 during assembly. At the end of the cutout region, a cross plate 46 is welded in place transversely of the longitudinal axis of the beam 42. The cross plate 46 has a central opening and a coarse-threaded nut 48 welded or otherwise affixed to the back side of the cross plate 46 in alignment with its central opening. This construction permits the attachment of the connector beams 42 to the main frames 40.

Figure 6:
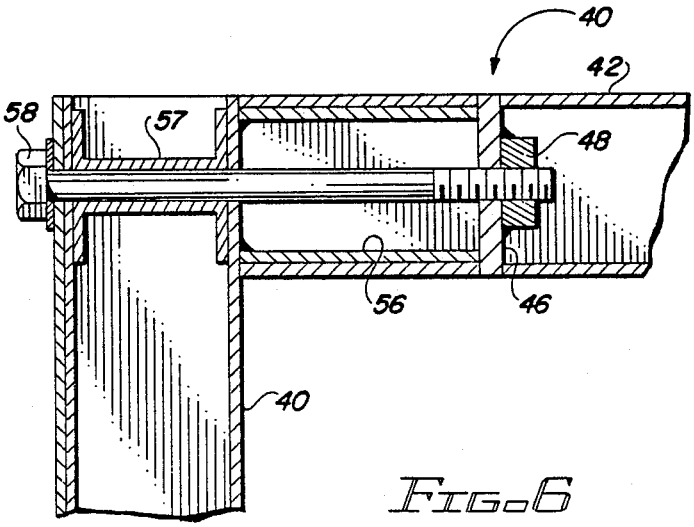
FIG. 6 is an enlarged view of a portion of FIG. 5 showing particular details of the connection of a main frame and the beam.
Figure 7:
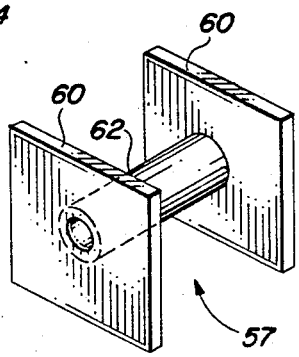
FIG. 7 is a view of a spacer element used in the assembly of beams and main frames of the present invention.

This is better illustrated in FIGS. 5 and 6 which show a single connector beam 42 coupled between a pair of parallel main frames 40, interconnecting a pair of opposed corners of the two main frames. Once the connector beam 42 is in place extending between and resting upon the stub carriers 56, spacers 57 (see FIG. 7) and bolts 58 are inserted into the main frames 40. As particularly shown in the detailed view of FIG. 6, the bolt 58 extends through openings in opposite walls of the ends of the horizontal sections of the main frame 40, through the central opening of the cross plate 46 to threadably engage the nut 48. Tightening the bolt 58 into the nut 48 fastens the connector beam 42 to the main frame 40 in a rigid connection. The spacer 57, particularly shown in FIG. 7, comprises a pair of opposed plates 60 which are welded to a tube 62 through which the bolt 58 is inserted. The plates 60 support the tube 62 at the proper position for alignment with the main frame bolt holes so that the fastening bolt may be readily slipped into the tube 62 and at the same time the spacer tube serves as a guide for the bolt in establishing alignment with the second hole in the main frame. The spacer 57 also serves to prevent the corners of the main frame 40 from being deformed as the bolt 58 is tightened to rigidize the joint between the connector beam 42 and main frame 40.

FIGS. 8 and 9 show wall brackets of two different configurations, Z-shaped and W-shaped, for mounting at the inside corners of the building to secure the wall panels and roof panels in the openings defined by the building frame. Each of the wall and roof panels comprises a core positioned within a surrounding mounting flange. The flange is typically formed of extruded sections which are welded together at mitered corners to form a rectangular frame. The wall panel mounting flanges are drilled with suitably located holes through which mounting bolts are inserted for attachment to the mounting brackets 70, 72. FIG. 10A shows one configuration of a wall panel such as 18 and flange strip 74 fastened to a column of a main frame 40 means of the Z-shaped bracket 70.

After the building frame is erected by connecting the main frames 40 and connector beams 42 in the manner previously described, the wall panels such as 18 with flange 74 and bolts 76 affixed are placed in the vertical openings of the building frame. From the interior of the building, the Z-shaped brackets 70 are then placed against vertical columns of the main frame 40 with the openings of the bracket 40 matching the bolts 76, and nuts 78 are secured thereon. Because of the clearance between the Z-bracket 70 and the wall panel 18, tightening the nut 78 on the bolt 76 draws the exterior flange 74 tightly against the column of the main frame 40, thereby securely holding the wall panel in place. When installed in this manner, the wall panels and the building frame work as an integral unit to further rigidize and firm up the building structure. Fabrication and assembly in this manner eliminates the need to drill any mounting holes on the site, since there are no holes in the beams of the main frame 40 nor is it necessary to drill any of the holes in the wall panels on the site or to worry about matching up any of the mounting holes. It will be understood that, prior to the installation of the building panels to the frame, all mating surfaces between the panels and the frame are coated with an appropriate sealant to make the structure weather tight and insect proof.

FIG. 10B shows an extruded flange 74' which is provided as an alternative to the extruded frame 73 and flange strip 74 shown in the panel mounting arrangement of FIG. 10A. The installation of the panel 18 and flange 74' through use of the Z-shaped wall bracket 70 is the same as already described.

FIG. 11 shows the use of a W-shaped bracket 72 in the mounting of two wall panels 18 or a wall panel 18 and a roof panel 36 to a main frame 40 or connector beam 42. Mounting of the W-shaped bracket 72 to the associated panels is similar to the mounting by tee Z-shaped bracket 70 of FIGS. 10A and 10B, except that the W-shaped bracket 72 is capable of connecting simultaneously to two right-angled panels.

FIGS. 12–15 are "stick" figures provided to show various arrangements of the basic elements herein which may be used in constructing different modular buildings according to my invention. In these figures, only the main frames and connector beams are indicated. The additional connector elements which permit these combinations will be shown and described in connection with succeeding figures of the drawings.

As indicated in FIG. 12, a two-bay modular building may be constructed from three main frames 40 and eight connector beams 42. Main frames 40A and 40B will be erected with their stub carriers 56 facing each other and then the four connector beams 42A would be connected as indicated in FIG. 5. Connections for the attachment of the connector beams 42B to the main frame 40B may be in accordance with the connection arrangement indicated in FIGS. 16A and 16B, described hereinbelow.

FIG. 13 illustrates a two-bay modular building frame design which may be constructed from four main frames 40 and eight connector beams 42. In this design, adjacent main frames 40A and 40B may be tied together in line by means of the connector arrangement illustrated in FIGS. 17A and 17B, described hereinbelow. Attachment of the connector beams 42 is by use of the stub carriers 56 and the connector scheme shown in FIGS. 5 and 6.

FIGS. 14 and 15 are similar "stick" figure diagrams showing ways of achieving a three-bay modular building in accordance with the present invention. The design shown in FIG. 14 utilizes four main frames 40 and twelve connector beams 42. FIG. 14 represents the addition of a basic module to the two-bay design shown in FIG. 12, by resort to the connection design which requires only one additional main frame 40.

FIG. 15 is a three-bay building frame design which utilizes five main frames 40 and twelve connector beams 42. This arrangement basically corresponds to the addition of a single main frame 40 and attaching connector beams 42 at right angles to the two-bay structure represented in FIG. 13.

Figure 16A:
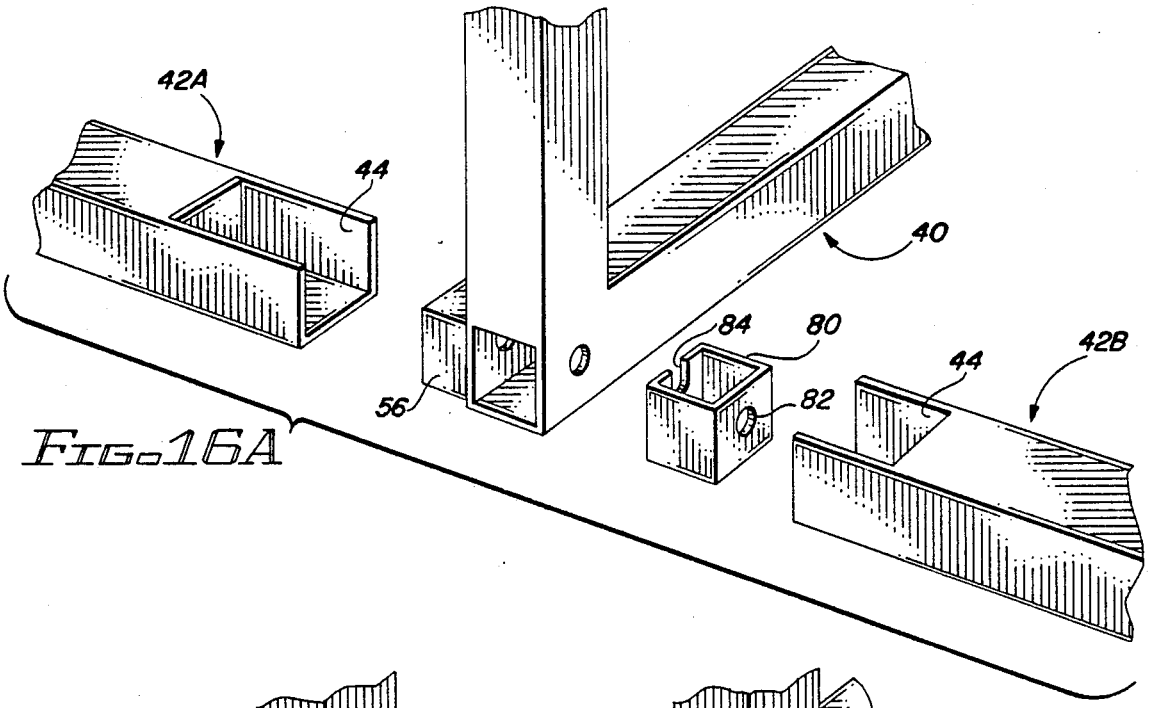

FIG. 16A and 16B illustrate one way in which a basic module may be extended through the attachments of connector beams to a transverse main frame from the side of the main frame opposite the position of the stub carriers. In FIG. 16A, a portion of a transverse main frame 40 is shown having a stub carrier 56 on its left-hand face. A portion of a connector beam 42A is shown ready for attachment over the stub carrier 56 in the manner already described. For attachment of the second connector beam 42B in line with the connector beam 42A, an extender coupler 80 is provided. The coupler 80 is essentially a cube, open along one face and having a bolt hole 82 and a slot 84 in opposed faces adjacent the open face. In a preferred connection method, the extender coupler 80 is attached to the end of the connector beam 42B by means of a short connector bolt (not shown) which is fed into the coupler 80 through the open face and then through the hole 82 to engage the coarse-threaded nut in the cross plate at the end of the beam 42B (see FIG. 4). The beam 42B is then ready for attachment to the main frame 40 by slipping the edges of the slot 84 under the head of the connector bolt (not shown) which is used to secure the beam 42A to the main frame 40 illustrated in FIG. 16A. The bolt may be tightened by a wrench which is provided access through the open face of the coupler 80. The completed assembly is represented in FIG. 16B, where the connector beams 42A and 42B are shown drawn tightly up against the main frame 40 so that only the spacer 57 is visible from this angle. This connecting method would be utilized in construction of the two-bay module represented in FIG. 12, for example.

Figure 17A:
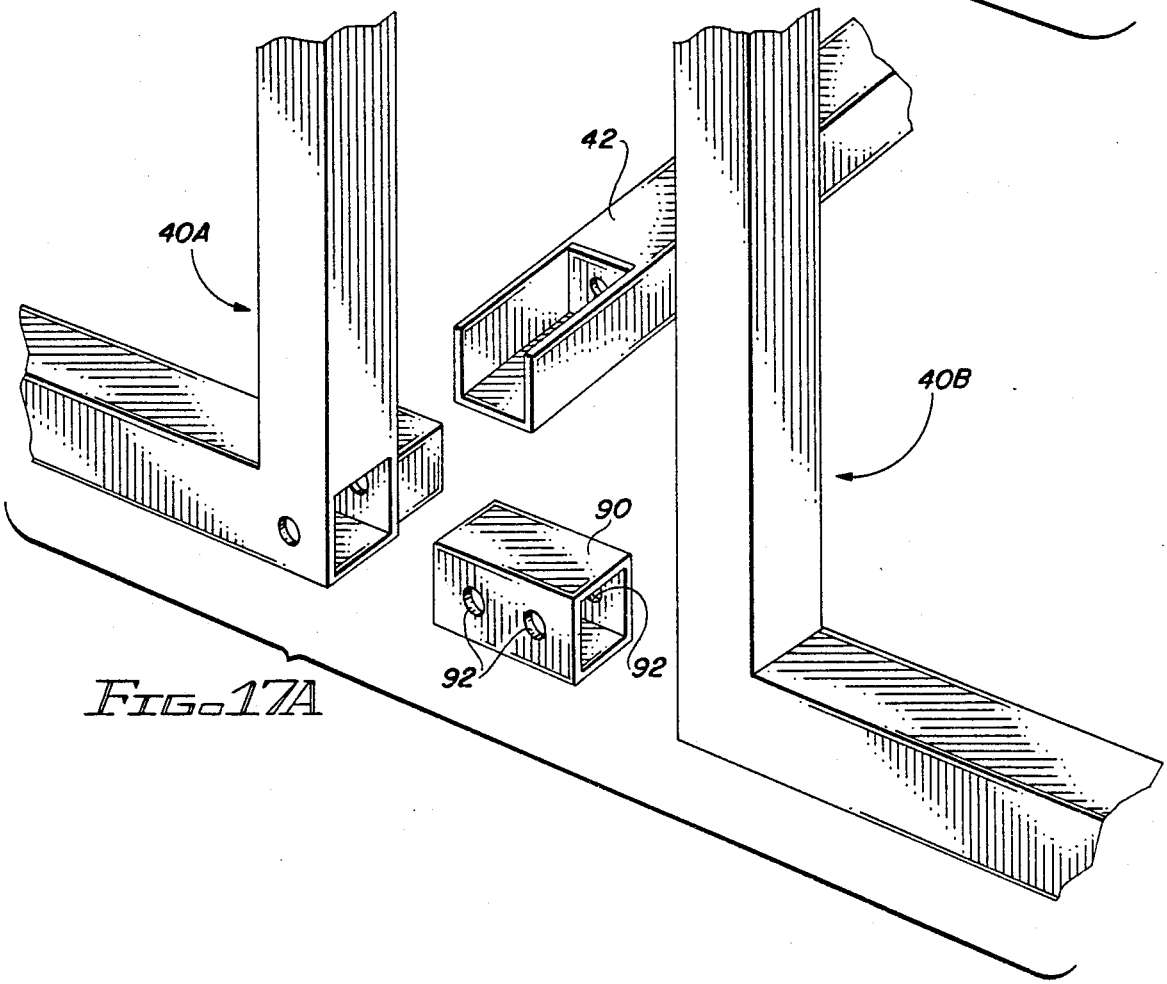

FIG. 17A and 17B show an arrangement for connecting a pair of main frames 40A and 40B in an in-line configuration corresponding to the design depicted in FIG. 13. This connection method utilizes a main frame coupler 90 which is essentially a short section of box tubing dimensioned to fit within the 4"×4" box tubing of the main frames. Two opposing faces of the coupler 90 are provided with pairs of holes 92 which are positioned to be aligned with the holes in the main frames 40A and 40B. Typically spacers 57 are inserted in the coupler element 90 in alignment with the holes 92, and then one end of the element 90 is slipped into the opening at the base of the main frame 40A and the first bolt 58 is used to hold it in place and to engage the corresponding connector beam 42 in the manner previously described. The second main frame 40B is then moved into position over the extending end of the coupler 90 and the second bolt 58 is inserted to connect to a corresponding connector beam. FIG. 17B shows the completed assembly of the main frames 40A and 40B for this type of connection arrangement. The space between the main frames 40A and 40B is variable depending upon the dimensions selected for the in-line coupler 90. Thus the space between the in-line main frames 40A and 40B may be varied from almost zero, as shown in FIG. 17B, to several inches or a few feet, as desired.

Figure 18:
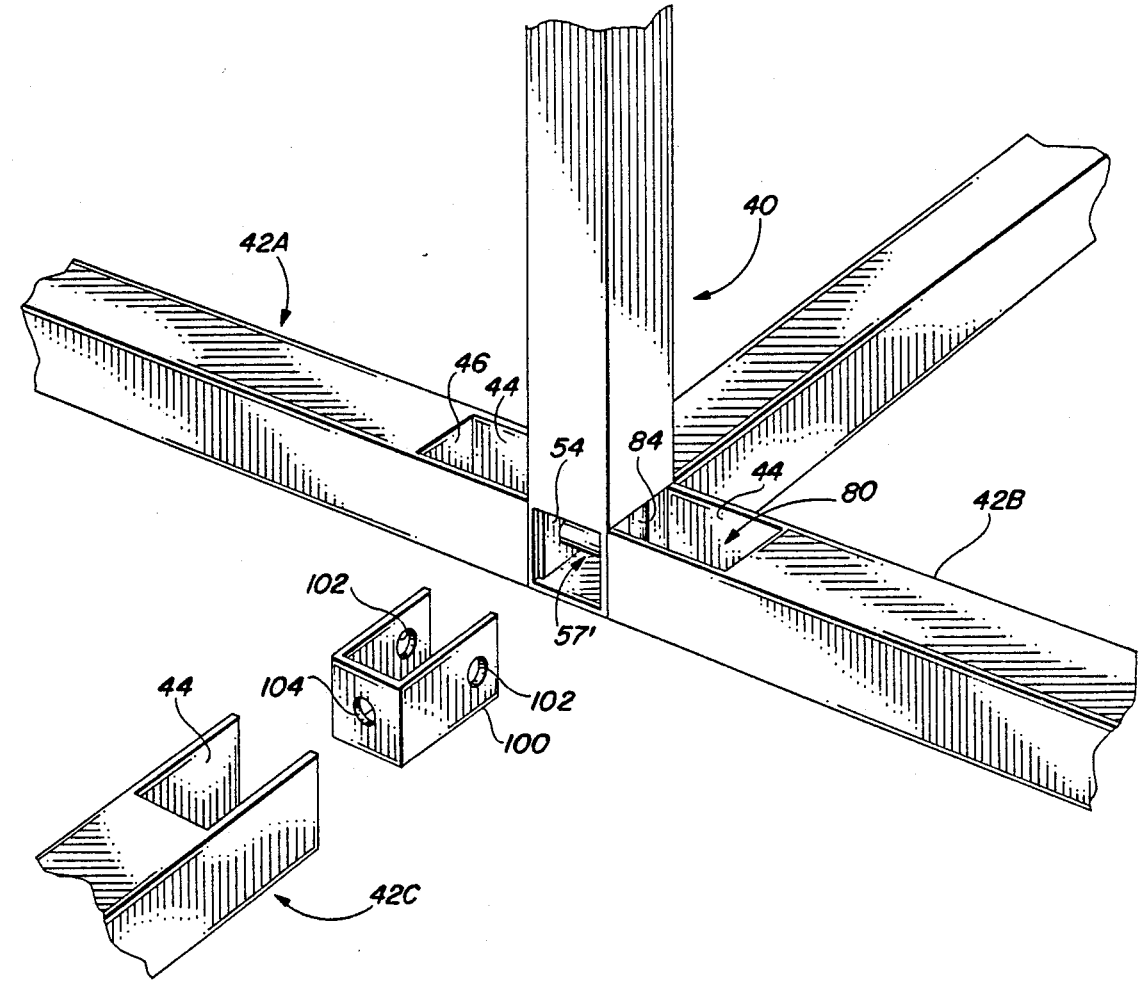
FIG. 18 is a schematic view illustrating how a plurality of connecting beams may be connected to a main frame to extend building walls in a third direction from the main frame through the use of a transverse coupler in accordance with the present invention.

FIG. 18 illustrates an arrangement for constructing an L-shaped modular building, corresponding to the design indicated in FIG. 14, for example. FIG. 18 shows a single main frame 40 with connector beams 42A and 42B attached in the manner of FIGS. 16A and 16B. With the addition of an orthogonal coupler 100, a third connector beam 42C can be attached to the same common junction of the beams 42A and 42B. The coupler 100 is dimensioned to fit into the openings 44 of the connector beam 42C and 54 of the main frame 40. It has a pair of holes 102 in its opposite sides and a third hole 104 in a closed end plate of the coupler 100. The hole 104 is for the purpose of permitting attachment to the end of the beam 42C in the manner described with respect to the extender coupler 80 of FIG. 16A. Holes 102 are for engaging the bolt 58 (see FIG. 6) which ties together the beams 42A and 42B. A different sized spacer 57' is used in this arrangement, the spacer 57' being like the spacer 57 except that it is dimensioned to fit within the coupler 100 in alignment with the holes 102.

With the coupler 100 attached t the beam 42C, and before the bolt 58 is inserted to tie together the beams 42A and 42B, the beam 42C and coupler 100 are moved into position within the opening 54 at the base of the main frame 40. The attachment bolt is then slipped through the slot 84 of the coupler 80 at the end of the beam 42B, through the aligned holes in the main frame, coupler 100 and spacer 57', and then tightened in engagement with the nut in the end plate 46 of beam 42A.

This versatility in providing connector elements adapted to extend the modular building in any direction from the main frames of the basic module permits the construction of buildings which may be L-shaped, square or rectangular with any number of basic modules (or bays) as desired. As noted above, additional modules can be stacked, one above the other, so that a multistory construction can be achieved. The structural elements making up the modular building design are almost totally prefabricated in a central factory, thereby contributing to a substantial reduction in overall cost while extending the versatility of the modular shell design because of the fact that erection of the housing on the building site can be accomplished quickly and easily with a minimum number of special tools and skilled workmen. The modular housing design of the present invention also permits ready disassembly for re-use or storage, as desired. The various components making up the modular design are all essentially two-dimensional elements so that stacking of the components into a very compact package for transportation or storage is possible.

Figure 19:
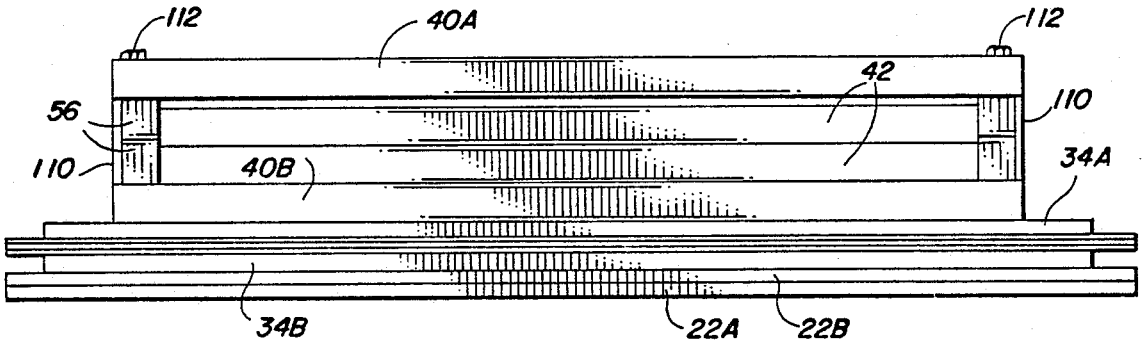
FIG. 19 is a sketch showing the components of a basic building module in accordance with the present invention arranged in a shipping package.

FIG. 19 illustrates one particular arrangement for stacking the components making up a single basic module. In this arrangement, a pair of main frames 40A, 40B are stacked with the stub carriers 56 facing each other. Sleeves 110 are placed over the stub carriers 56 to hold the main frames 40A, 40B in position, and shipping bolts 112 are inserted to lock the combination together. In the spaces between the two main frames, the connecting beams 42 are positioned, together with the side wall panels. Two roof panel sections 34A and 34B and two floor panel sections 22A and 22B are shown stacked below the main frame/connector beam combination to make up the basic module package.

Although there have been described above specific arrangements of a modular building system in accordance with the invention for the purpose of illustrating the manner in which the invention may be used to advantage, it will be appreciated that the invention is not limited thereto. Accordingly, any and all modifications, variations or equivalent arrangements which may occur to those skilled in the art should be considered to be within the scope of the invention as defined in the annexed claims.

What is claimed is:

1. A modular building system comprising:

a rigid modular frame having first and second pluralities of tubular frame members interconnected in a basic module to form a rectangular parallelepiped with opposed faces defining openings surrounded by interconnected frame members of said first and second pluralities;

a plurality of panels dimensioned to fit in said openings and adapted for mounting to said surrounding frame members;

said first plurality of said tubular frame members being prefabricated to form a pair of rigid two-dimensional main frames and said second plurality of said tubular frame members being provided with attaching means for connecting the tubular frame members of the second plurality between said pair of rigid two-dimensional main frames to form said rectangular parallelepiped;

wherein each main frame comprises a first pair of continuous weld box tubing members welded between opposite ends of a second pair of continuous weld box tubing members in a closed rectangle with means defining aligned pairs of holes in opposed faces of said main frame at each of the corners of said rectangle; and a plurality of elongated first fastening means for inserting through said holes to engage the attaching means of the frame members of said second plurality.

2. The system of claim 1 wherein said attaching means comprise a transverse cross plate mounted at each end of the frame members of said second plurality with a female threaded fastener affixed thereto in a position to receive the first fastening means extending through the holes of a corresponding corner of the main frame.

3. The system of claim 2 wherein the frame members of the second plurality comprise sections of box tubing formed as connector beams, each end of a connector beam having a cutout extending back from the end along one face of the beam, the cross plate being welded in position adjacent the termination of said cutout, and further including stub carrier elements affixed to the main frames at the corners thereof and extending transversely of the face of the main frame in positions generally surrounding the hole in said face.

4. The system of claim 3 further including coupling members for extending the modular system beyond the main frames of a basic module, said coupling members being adapted to attach additional connector beams to a main frame of said parallelepiped.

5. The system of claim 4 wherein said coupling members include a first coupler configured for attachment at one end thereof to the female threaded fastener at one end of a connector beam and having a slot at the other en of the coupler for engaging the head of a fastener bolt which is positioned to secure another connector beam on the opposite side of the main frame.

6. The system of claim 4 wherein the coupler members comprise a second extender member for joining two main frames in an in-line juxtaposition, the second extender member having means defining a plurality of pairs of holes in opposite faces of the member for receiving fastening bolts in the two main frames when the second coupling member is inserted into open ends of horizontal box tubing members of two adjacent main frames.

7. The system of claim 4 wherein said coupling members include an orthogonal coupler having an apertured end plate and a pair of apertured side plates, said coupler being dimensioned to fit into the open end of the horizontal box tubing members of a main frame, the apertures of the side plates being aligned to engage a fastening bolt extending through the main frame and the aperture in the end plate being located for fastening to a female threaded attaching means of a connector beam.

8. The system of claim 1 wherein the panels include a surrounding flange having an extended face adapted to fit along one face of a main frame, and panel fastening means for mounting the panels within an opening of a main frame by engaging the main frame along opposite faces thereof.

9. The system of claim 8 wherein the panel fastening means comprise a Z-shaped mounting member with openings for receiving bolts extending through the panels into the interior of the building, and threaded nuts for drawing the Z-shaped fastener and the panel together from opposite sides of the main frame.

10. The system of claim 8 wherein the panel mounting means comprise a W-shaped member having openings for receiving bolts extending toward the interior of the building, through adjacent panels at a corner of the modular frame, and threaded nuts for drawing the W-shaped member and a pair of corner panels together from opposite sides of the main frame.

* * * * *